US005526754A

United States Patent [19]

Kunczynski

[11] Patent Number: 5,526,754

[45] Date of Patent: Jun. 18, 1996

[54] CONVEYING SYSTEM WITH TENSIONING ASSEMBLY AND METHOD

[75] Inventor: Jan K. Kunczynski, Glenbrook, Nev.

[73] Assignee: Yantrak, LLC, Carson City, Nev.

[21] Appl. No.: 335,096

[22] Filed: Nov. 7, 1994

Related U.S. Application Data

[63] Continuation-in-part of Ser. No. 69,082, May 28, 1993, Pat. No. 5,361,706.

[51] Int. Cl.[6] ..... B61B 11/00

[52] U.S. Cl. ..... 104/196; 198/750.1; 198/810.04

[58] Field of Search ..... 104/173.1, 193, 104/196; 188/312; 198/750; 254/199, 231, 232, 233; 242/410

[56] References Cited

U.S. PATENT DOCUMENTS

| | | | |
|---|---|---|---|
| 1,273,059 | 7/1918 | Hild | 188/312 |
| 3,113,767 | 12/1963 | Halberstadt | 198/750 |
| 3,437,315 | 4/1969 | McDonald | 104/196 |
| 3,875,868 | 4/1975 | Martin | 104/173.1 |
| 4,308,945 | 1/1982 | Beckmann et al. | 104/173.1 |
| 4,787,761 | 11/1988 | Asberg | 104/196 |

FOREIGN PATENT DOCUMENTS

| | | | |
|---|---|---|---|
| 1431664 | 2/1966 | France | 104/173.1 |
| 629712 | 5/1982 | Switzerland | 104/196 |
| 614007 | 7/1978 | U.S.S.R. | 104/193 |
| 17333308 | 5/1992 | U.S.S.R. | 104/173.1 |

*Primary Examiner*—Robert J. Oberleitner
*Assistant Examiner*—S. Joseph Morano
*Attorney, Agent, or Firm*—Flehr, Hohbach, Test, Albritton & Herbert

[57] ABSTRACT

A conveying or transportation system having a haul rope (22) mounted for movement along a path, and a carrier unit (27) coupled to the haul rope (22). The carrier unit (27) is coupled to the haul rope (22) by a rope coupling assembly (51), which preferably includes a tension sensing device (139) and a screw jack tension adjustment assembly (141, 142,143,144) formed to respond to sensed tension in the haul rope (22) to adjust the same at the terminals (31). The screw jack tension adjustment assembly (53) preferably includes two screw members (141,142) which are movably mounted in collar assemblies (143,144) and driven by a motor (162) to tension or relax the haul rope (22). A method of automatically maintaining and adjusting the tensioning of the haul rope (22) also is provided.

18 Claims, 4 Drawing Sheets

CONVEYING SYSTEM WITH TENSIONING ASSEMBLY AND METHOD

RELATED APPLICATION

This application is a continuation-in-part application based upon copending application Ser. No. 08/069,082, filed May 28, 1993, entitled "Conveying System With Tensioning And Docking Assembly And Method," now U.S. Pat. No. 5,361,706.

TECHNICAL FIELD

The present invention relates, in general, to transportation or conveying systems, such as rail-mounted and aerial tramways, which are conveying systems driven by a traction member, and more particularly, relates to shuttle-type automated people mover systems in which the traction member is a haul rope and the haul rope tension must be properly maintained.

BACKGROUND ART

Shuttle-type transportation or conveying systems have been employed in which two passenger or load carrier units are coupled in a loop-type haul rope and driven back and forth between terminals, usually located proximate the ends of the haul rope loop. Such systems may or may not include intermediate terminals, and the passenger carrier units may be supported by wheels on a support surface or track, or suspended from the haul rope by means of support sheaves over part or all of the path.

A constant problem in such shuttle tramway systems is maintaining uniform, and preferably symmetrical tensioning forces in the haul rope. This is usually accomplished at the haul rope drive or bull wheels or through a counterweight assembly acting on the haul rope. Counterweight systems result in rope tension forces which are not always symmetrical in terms of the direction of driving of the haul rope, and bull wheel tensioning systems require complex carriage mounting assemblies.

Another difficult problem in connection with shuttle tramway systems is the problem of accurate docking at the terminals. Federal handicap access regulations require, for example, that there be no more than a one inch gap between the passenger carrier unit and the terminal at the ingress and egress doors for systems having a maximum speed of 20 miles per hour and not more than a three inch gap for systems having a maximum speed over 20 miles per hour.

In haul rope-driven conveying systems, the bull wheel which drives the haul rope can only be slowed and stopped with a certain degree of precision. It is desirable to accelerate the carrier units from zero to their maximum velocity and then decelerate them back down to zero at rates which are comfortable to passengers. The mass of the carrier units and their load (which will vary), however, will cause elastic stretching and even oscillation of the haul rope during the docking process and can produce slippage of the haul rope with respect to the driving bull wheel. Thus, over time, the combination of bull wheel imprecision, haul rope elasticity and carrier unit mass will create unacceptable docking imprecision, which in turn requires system adjustments. The problem is further complicated when two passenger carrier units are driven by a single haul rope in a shuttle system at which the passenger carrier units must dock simultaneously at opposed end terminals.

Haul rope tensioning devices have been employed in conveying systems which are mounted to the system carrier unit. U.S. Pat. No. 3,437,315, for example, shows a turn buckle-type tensioning assembly which is resiliently coupled between ends of a haul rope and the load carrying unit. This system, however, has no provision for sensing haul rope tension, much less automatically responding thereto to adjust rope tension. The haul rope adjustment assembly of this patent also is unpowered and must be manually adjusted. Russian Patent No. 614,007 shows a similar manually adjustable rope tensioning assembly.

In Swiss Patent No. 629,712 a device is shown for docking carrier units in a shuttle-type conveying system. The docking assembly docks one of two cars at a terminal and then reels or draws in the haul rope to dock the second car. This system, however, is not used to control haul rope tension. Other docking assemblies which do not control haul rope tension are shown in U.S. Pat. Nos. 3,875,868, 3,113,767 and 1,273,059, as well as French Patent No. 1,431,664 and Russian Patent No. 1,733,308.

Automatically maintaining the tension in traction members, and particularly metallic haul ropes, within prescribed limits, for example, 12,000 to 15,000 pounds, is also important and difficult to achieve. For example, the haul rope will predictably stretch during the first month of operation. Moreover, temperature changes can significantly effect the metal haul rope length. In a 1,000 foot long shuttle installation and a temperature difference of 56° F. will produce a rope length change of 4.3 inches, which can cause, or combine with heavy loading to cause rope slipping on the bull wheels or undesirably high stress on the rope drive, particularly the drive output shaft. The tensioning problems are less severe in belt-type traction members because they usually operate at much lower tension forces.

In various urban environments, for example, at airports, considerable use of shuttle conveying systems has been made. Most of these systems, however, tend to be based upon a single car or passenger carrier unit that is railmounted and driven by a motor carried by the car or by driven tires adjacent to the car along the path to be travelled. Very little has been done with traction member-driven passenger conveying systems in urban applications.

Accordingly, it is an object of the present invention to provide a tensioning apparatus and method for a traction member-driven automated people mover transportation system which automatically adjusts haul rope tension on an as needed basis and allows symmetrical rope tension to be achieved regardless of the direction of haul rope advancement.

It is another object of the present invention to provide a haul rope-driven, load carrying, conveying or transportation system having a docking assembly which is capable of precise, repeated docking of the load carrying units or vehicles at terminals.

Still another object of the present invention is to provide a haul rope-driven passenger conveying system suitable for use in urban environments and having improved tensioning and docking capability.

Still a further object of the present invention is to provide a shuttle-type passenger conveying system which is durable, has a minimum number of components, can be easily repaired and maintained, and does not require an on-board operator.

The conveying system of the present invention and method have other features and advantages which will become apparent from and are set forth in more detail in the following description of the Best Mode Of Carrying Out The Invention.

DISCLOSURE OF INVENTION

In one aspect, the conveying or transportation system of the present invention comprises, briefly, a traction member, preferably an endless loop-type haul rope, mounted for movement to a plurality of support sheaves, a load carrying unit coupled to the haul rope, a tension sensing device coupled to the haul rope, and a haul rope tensioning assembly carried by the load carrying unit and formed to be responsive to the tension sensed in the haul rope to adjust haul rope tension according to input criteria.

The method of tensioning a traction member, such as a haul rope, in a traction member-driven conveying system is comprised, briefly, of the steps of periodically sensing the tension force in the haul rope while the haul rope is under substantially zero driving force, and adjusting the tension force within a predetermined range in response to a sensed tension force outside the range.

BRIEF DESCRIPTION OF THE DRAWING

FIG. 1 is a fragmentary, top plan view corresponding to FIG. 1.

BEST MODE OF CARRYING OUT THE INVENTION

The conveying apparatus and method of the present invention is particularly well suited for automated people moving applications. It will be understood, however, that it can also be used in connection with the transportation of loads other than human passengers. Similarly, the present transportation conveying apparatus and method is particularly well suited for applications in urban environments, such as the transportation of passengers between an airport and the parking structure, but it can also be used at ski resorts or other non-urban facilities to transport people from one location to the other. The present haul rope-driven conveying system is essentially a horizontal elevator in which rope tensioning and docking problems have been alleviated by the manner in which the cabin, car, vehicle or carrier unit is coupled to the haul rope.

Figure 1:
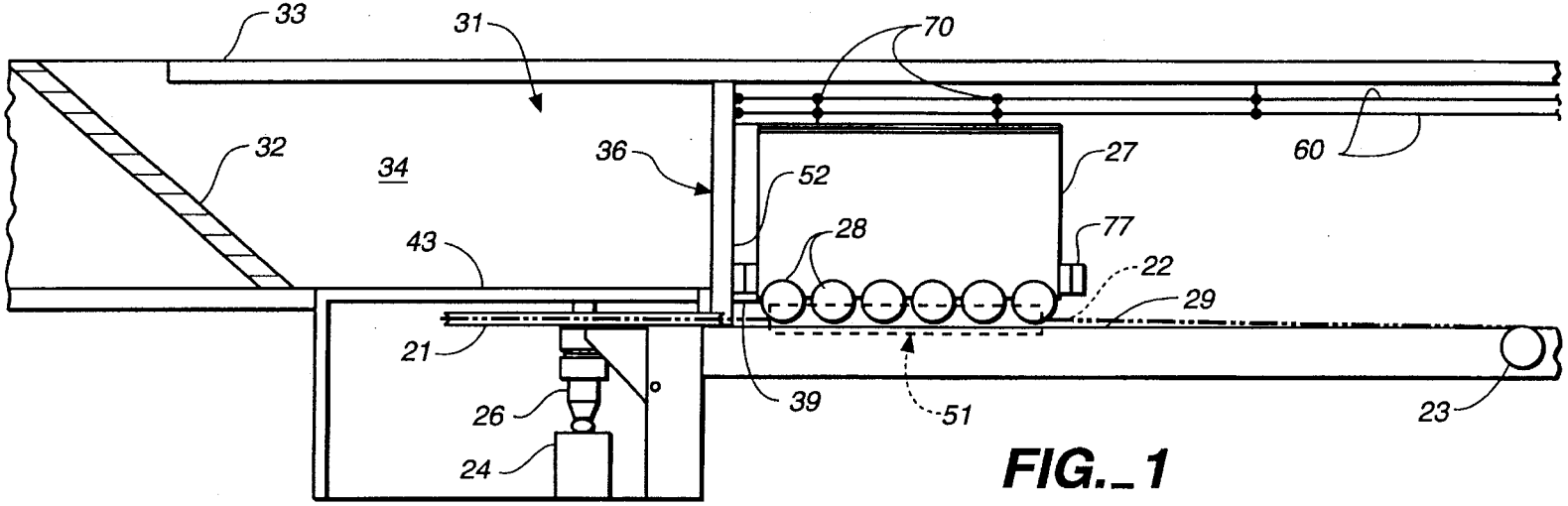
FIG. 1 is a fragmentary, side elevation, schematic view of a passenger carrying conveying system constructed in accordance with the present invention.
Figure 5:
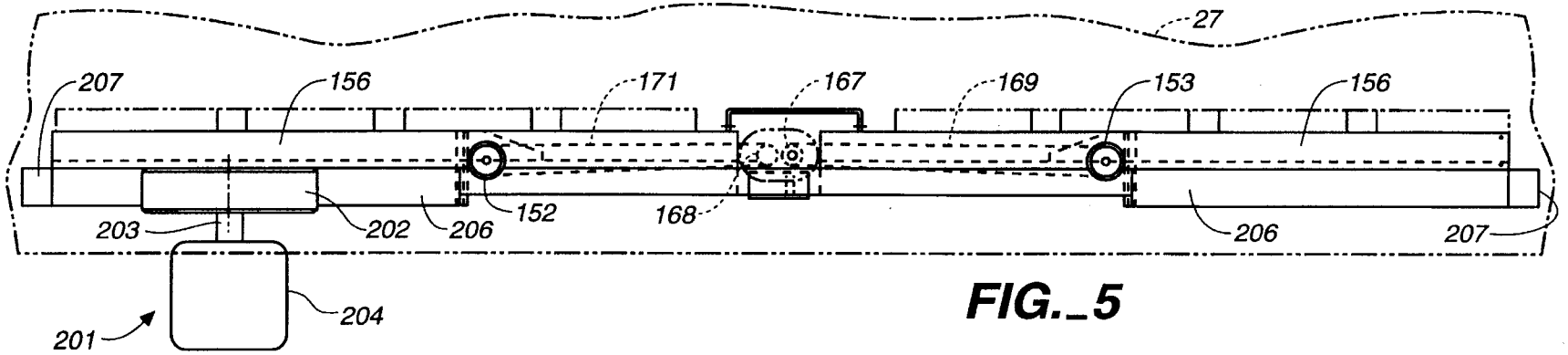
FIG. 5 is a side elevation view in cross section, taken substantially along the plane of line 6—6 in FIG. 4.
Figure 2:
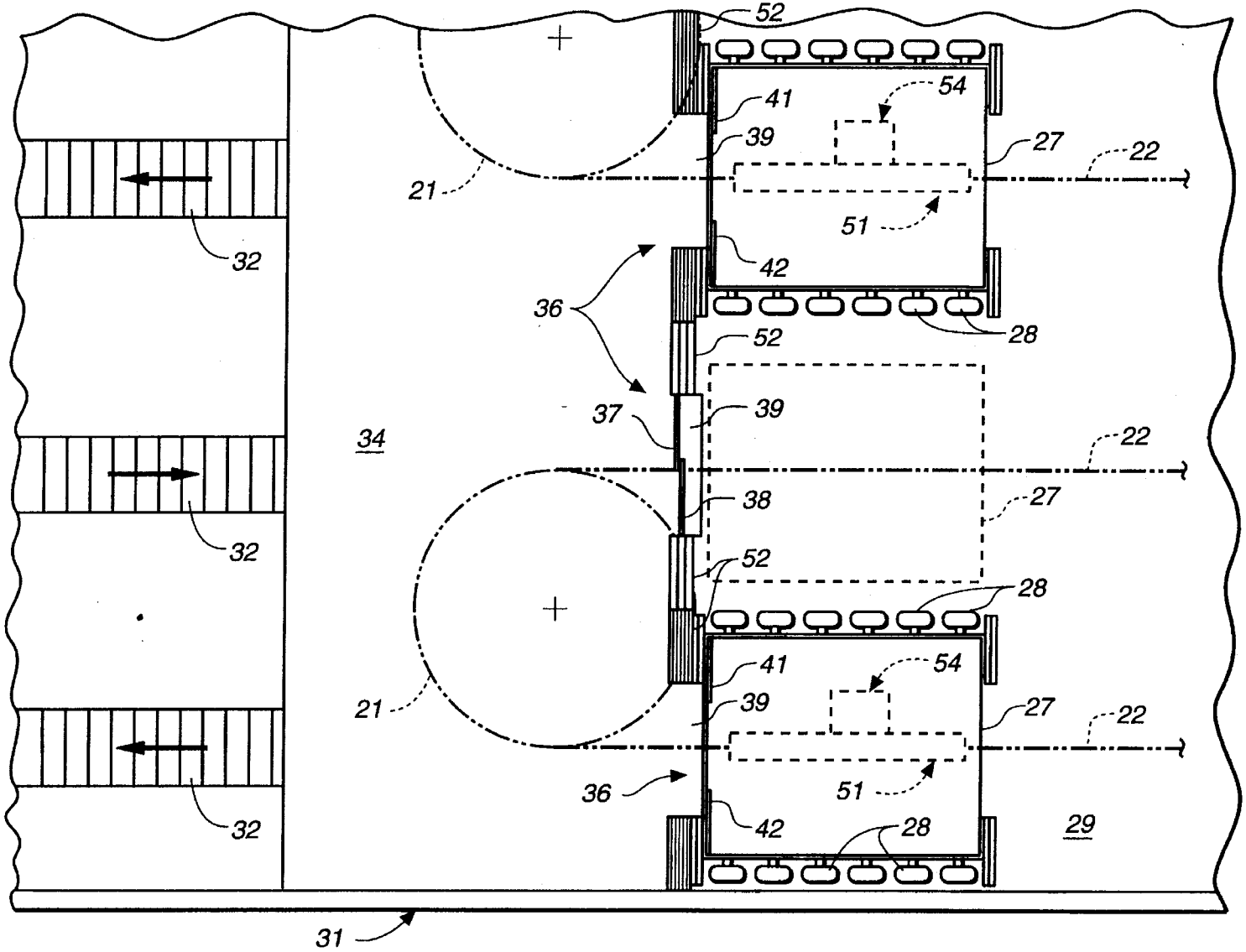

Referring now to FIGS. 1 and 2, an installation of the conveying or transport system of the present invention is shown which would be typical of an airport parking lot-to-terminal application. Mounted on a horizontal drive or bull wheel 21 is a traction member, such as a haul rope 22. Various support sheaves 23 can be provided along the path of the conveying system for support of haul rope 22, and bull wheel 21 is driven by motor and controller 24 and drive train assembly 26 in a manner well known in the aerial tramway art. Most typically, a second horizontal bull wheel (not shown) will be placed at the opposite end of the path, and the haul rope will return to the opposite side of bull wheel 21, as best may be seen in FIG. 2.

Coupled to haul rope 22 to be driven thereby is a car, cabin, vehicle or carrier unit 27, having a plurality of wheels 28 which engage a support surface 29 over which the load carrying unit is advanced by the haul rope. Support surface 29 may include a pair of rails which receive flanged wheels or grooved sheaves or it may be a smooth support surface engaged by rubber tires. Rails, however, are the preferred support surface. A first terminal, generally designated 31, typically will be provided proximate one end of the looped haul rope, and a second terminal (not shown in FIGS. 1 and 2) will be provided at the opposite end of rope 22 and will be formed substantially as shown and described in connection with first end terminal 31, except that the bull wheel at the second terminal will normally be an idler wheel, not a driven bull wheel.

In various conventional conveyor systems one of bull wheel 21 and the opposite bull wheel will be mounted on a carriage which can be moved, pneumatically, hydraulically or through the use of a counterweight, away from the other bull wheel. This movement tensions haul rope 22. Alternatively, counterweights are sometimes used intermediate the bull wheels to effect rope tensioning, but that approach is not practical for systems having a vehicle or car on both sides of the haul rope loop.

Systems which employ a drive bull wheel at one end of the loop and a carriage which has a counterweight or an active tensioning force applied during driving of the carriage will produce tension forces in the haul rope which are not symmetrical or the same when the direction of driving of the carrier unit is reversed. Moreover, carriage-mounted bull wheels inherently have more components than stationary bull wheels.

In the conveying system of the present invention, both bull wheels on which the endless loop-type haul rope is mounted are stationary, and all haul rope tension is generated and controlled at carrier unit 27, which greatly simplifies construction and maintenance of the transportation system.

Returning to FIGS. 1 and 2, an escalator or stairway 32 can lead from the ground surface level 33 to a waiting room area 34 in terminal 31. A doorway, generally designated 36, having retractable doors 37 and 38 provides an entrance to the load carrying unit 27 which also has retractable doors 41 and 42. Doorway structure 36 can include an outwardly extending apron portion 39 that is on the same floor level 43 as the rest of the waiting room and is at the same floor level as the floor in carrier unit 27. Although not shown, passenger carrier unit 27 will also include a second set of retractable doors at the opposite end of the cabin to allow ingress and egress to the unit through the opposite end when passenger carrier unit 27 is shuttled to the second terminal. Moveover, bumper assembly 77 cooperates to resiliently docking surface 52 in order to assist in precise docking and to reduce jarring. The structure of the doorway assemblies in the terminals, and the structure of the doors on the passenger carrier units are well known in the art, as are the automatic controls for opening the doors upon docking of the passenger carrier unit with the terminal.

It should also be noted in connection with FIG. 1 that power can be provided to passenger carrier unit 27 by overhead electrical transmission lines 60 to which the electrical system, including the various controls for coupling assembly 51, is connected through slidable couplings 70. Other techniques for providing power on carrier unit 27 and for operating coupling assembly 51 can be employed within the scope of the present invention.

As best may be seen in FIG. 2, each waiting area 34 in terminal 31 can include a plurality of doorways 36 against which load carrying units 27 will dock. The users can enter the passenger carrier units as they dock and the respective waiting room doors automatically open. The system is shown in an underground installation, but it will be understood that it also can be installed above ground, and even can be elevated.

It will be appreciated that it will be essential for load carrying units 27 to dock very closely to apron 39 so that passengers can walk on and off the load carrying unit without any danger. Federal codes now require that the gap be no greater than one inch if the transportation system is to be used by disabled users and has a maximum speed of 20 miles per hour. Up to three inches gap is permissible for systems having a speed over 20 miles per hour. Thus, load carrying unit 27 at one end of haul rope 22 must dock precisely with first terminal 31 as a similar load carrier 27 docks precisely with the end terminal at the opposite end of the haul rope. Since the haul rope distance can be anywhere from a few hundred to fifteen hundred feet, or possibly longer, stopping driving bull wheel 21 precisely is a substantial problem.

The conveying or transportation system of the present invention solves the rope tensioning and unit docking problem by providing a rope coupling assembly, generally designated 51, which is formed to create and maintain the tension in haul rope 22 necessary to shuttle the passenger carrier units between the end terminals, while also being formed for yieldable displacement of haul rope 22 with respect to carrier unit 27 upon engagement of carrier unit 27 with a docking surface to solve docking precision problems. Alternatively, a separate docking assembly can be employed, and rope coupling assembly 51 used merely to automatically maintain rope tension in a desired operating range.

In one embodiment of haul rope coupling assembly 51 suitable for both tensioning and docking a piston-cylinder assembly is provided which is connected to a fluid circuit. The fluid circuit is used to displace the pistons, preferably two opposed pistons, to tension haul rope 22. This embodiment is described in detail in the parent application to the present application, and such description is hereby incorporated by reference into the present application.

An alternate embodiment of rope coupling assembly 51 is shown in FIGS. 3 through 6. This embodiment is intended primarily for automated rope tensioning in a conveying system, with vehicle docking being adjusted by a separate docking assembly, which also will be described.

Figure 3:
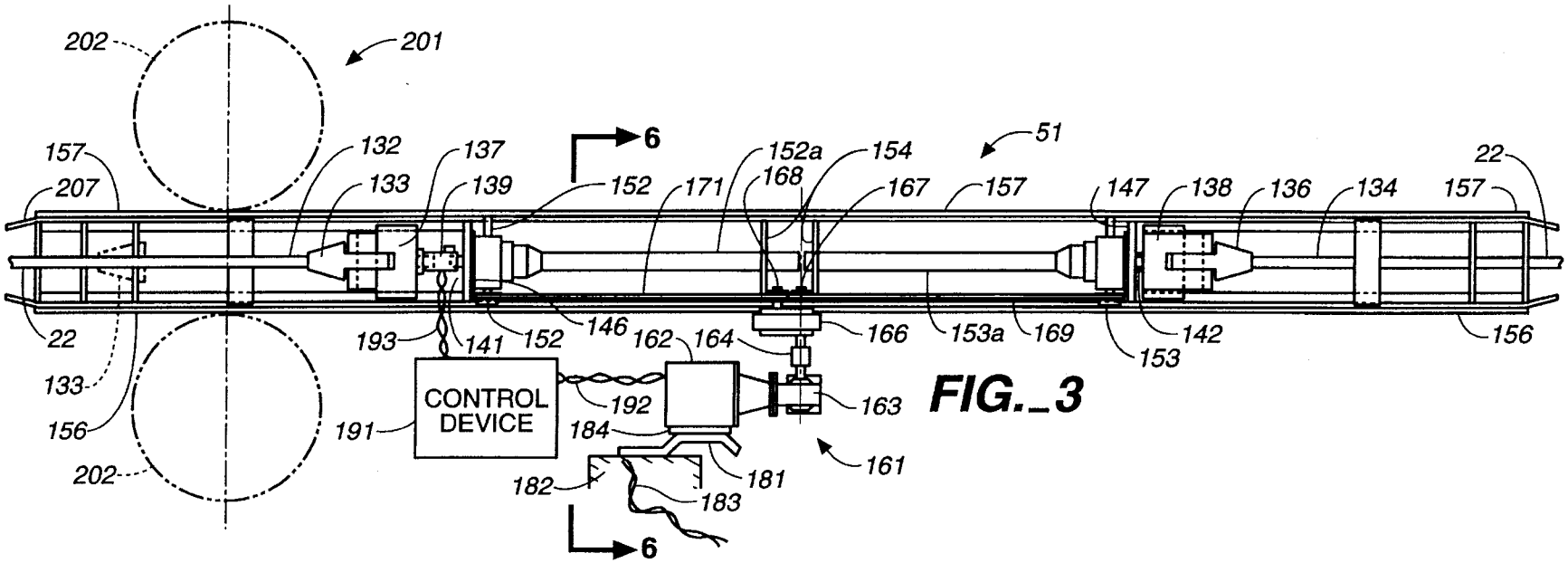
FIG. 3 is an enlarged, fragmentary, top plan view showing a rope tensioning assembly constructed in accordance with the present invention.
Figure 6:
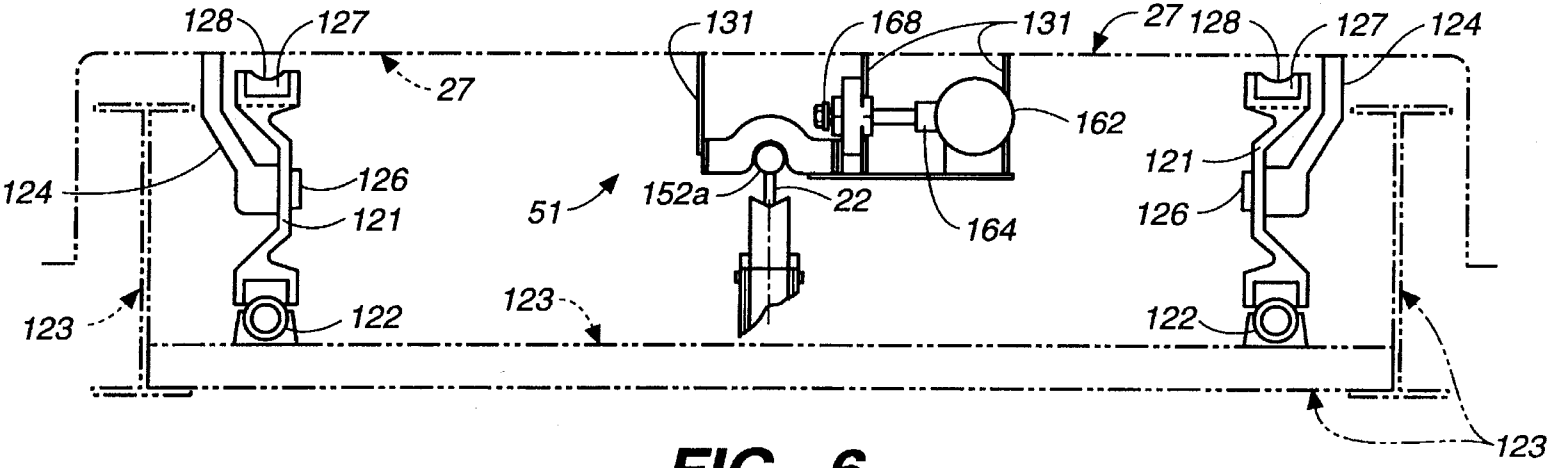
FIG. 6 is an end elevation view of the tensioning assembly of FIG. 3.
Figure 7:
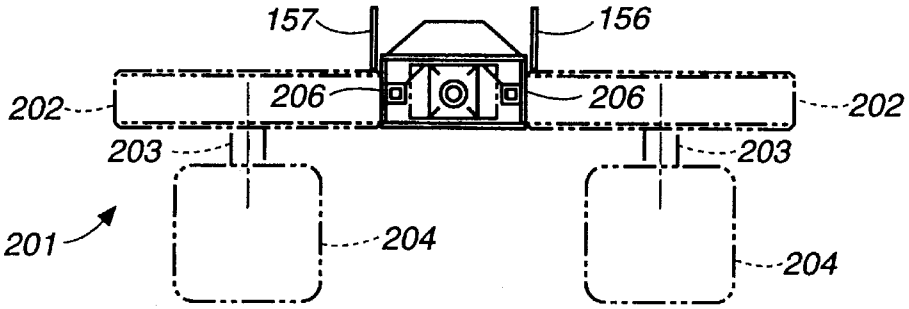
FIG. 7 is an end elevation view taken substantially along the plane of line 7—7 in FIG. 3.

Referring now to FIGS. 3 and 6, an embodiment of the on-board, automatic rope tensioning assembly 51 of the present invention, which is based upon the use of a screw jack assembly, is shown. As is the case for the pneumatic rope coupling assembly of the parent application, it is preferable that the screw jack rope coupling assembly 51 be mounted underneath carrier unit 27, for example, in the carrier unit undercarriage between support wheels or sheaves 121. Support wheels for carrier unit 27 may be advantageously provided as grooved sheaves 121 which are supported by an undercarriage mounting arm 124 on axles 126. The sheaves include an annular rubber member 127 having a groove 128 formed to ride on mating tubular pipes or rails 122 supported on a rail bed structure, generally designated 123. The use of grooved sheaves and mating tubular rails is well known in the tramway industry.

Traction member coupling assembly 51 can be supported from carrier unit 27 by brackets 131 in a generally central location underneath the carrier unit. As best may be seen in FIG. 3, an end 132 of rope 22 can be mounted in grip 133 of the haul rope tensioning assembly, while another end 134 can be mounted in a similar, oppositely facing grip 136 at the other end of the coupling assembly. Coupling assembly 51, in effect, provides a link between the ends 132 and 134 of haul rope 22. In the loop-type shuttle installation of FIGS. 1 and 2, therefore, the haul rope is "endless" in the sense that the coupling assemblies on the two carrier units provide links which complete the loop, although it will be understood that in such a shuttle system there are, in fact, four rope ends, two of them being shown in FIG. 3, namely, ends 132 and 134.

Grip assemblies 133 and 136 are coupled, respectively, to longitudinally displaceable grip housings 137 and 138. On the left side of FIG. 3, grip housing 137 is in turn coupled to a load cell 139, which is coupled at its opposite end to the end of a longitudinally displaceable screw element 141 (best seen in FIG. 4). At the opposite end of the assembly, movable grip housing 138 is coupled directly to the end of a longitudinally displaceable screw member 142. The screw members 142 in turn pass through a screw jack collar assembly 143 and 144. The collars 143 and 144 are mounted in a longitudinally stationary position to transversely extending support members 146 and 147, respectively. Each collar assembly 143, 144 further includes a transversely extending shaft 149 and 151 which has a sprocket 152 and 153 mounted thereon. Extending outwardly out of collars is a protective sleeve or tube **152*a* and 153*a* which covers the respective screws 141 and 142 so as to protect the same from debris and/or damage. The ends of protective covering tubes 152*a* and 153*a* are supported from the assemblies' longitudinally extending side members 156 and 157 by transversely extending flanges 154**.

In order to power the screw jack assembly drive shafts 149 and 151, a screw jack drive assembly, generally designated 161 (FIG. 3) is coupled to drive sprockets 152 and 153. This can be accomplished by coupling drive motor 162 through a gear reducer 163, coupling 164 and a sprocket gear assembly 166. Extending out of the gear assembly 166 are a pair of shafts having sprockets 167 and 168 mounted thereto. Drive chains 169 and 171 extend from sprockets 167 and 168 to the screw jack sprockets 152 and 153. Sprockets 168 and 167 preferably operate at the same speed, with one shaft merely being reversed by gear assembly 166 relative to the direction of operation of the other shaft.

As will be seen from FIG. 6, drive motor 162 is also carried on brackets 131 underneath carrier unit 27. Accordingly, the traction element tensioning assembly 51 of the present invention can be completely mounted on-board the carrier unit. It should be noted, however, that it also is possible to mount drive motor 162 at a predetermined known location, for example the terminal, and merely couple the drive motor to drive the screw jack assemblies to change rope tension when the carrier unit 27 is positioned in a docked or predetermined relationship in the terminal.

While it is possible to power motor 162 through power transmitted to carrier unit 27 through electrical conductors 60 and sliding couplers or brushes 70, in the preferred form, motor 162 is provided with electrical power by an electrical contact or brush 181 which is mounted at a portion of the terminal 182 and coupled through conductors 183 to a source of electricity. A similar motor electrical contact 184 can be provided in a position so as to be engaged by shoe or brush member 181 when passenger carrier unit is docked in the terminal. This source of electrical power can be used to power drive motor 162 alone, or it also can be used to provide electrical power for control device 191, through conductors 192 and from there to load cell 139 through conductors 193.

Since control device 191 and load cell 139 typically consume very little power, they can be easily connected to the on-board power provided through conductors 60, rather than being powered through a power connection to motor 162. In either electrical configuration, the control device 191 can be provided by a chip or general purpose digital computer which is capable of executing other simple control functions and of accepting user input as to the control parameters, in the manner which will be described below.

As will be apparent from the above description, the conveying system of the present invention has a coupling assembly 51 which includes a tension adjustment assembly coupled to traction element or haul rope 22 having the form of a screw jack assembly. Moreover, the conveying system of the present invention includes a tension sensing device, or load cell 139, which is carried by the carrier unit and formed to sense tension forces in haul rope 22. In this case, the load cell is coupled in series with the haul rope as part of the link between ends 132 and 134. The load cell can be any one of a number of commercially available load cells which produces an output signal through conductors 193 to control device 191 that is proportional to the sensed tension force in haul rope 22.

The system can be programmed to provide, for example, a range of tension forces in which to maintain haul rope 122. A typical range might be, for example, between 12,000 pounds and 15,000 pounds tension force on rope 22. These limits, or any selected limits, can be input to control device 191 by the system designers, and the control device and tension adjustment assembly will automatically respond to tension load sensed by load cell 139 to maintain tension in haul rope or traction member 22 within the desired range.

While haul rope 22 will periodically require that its tension be adjusted, such adjustments in most conveying systems are relatively infrequent. Thus, it might be typical that in an environment having extreme temperature changes, for example, in excess of 50° F. during a day, the haul rope tension might be adjusted twice in the course of a day. It is not necessary, therefore, for coupling assembly 51 to constantly adjust rope tension, but it is desirable for tension sensing device 139 to regularly sense haul rope tension.

Figure 4:
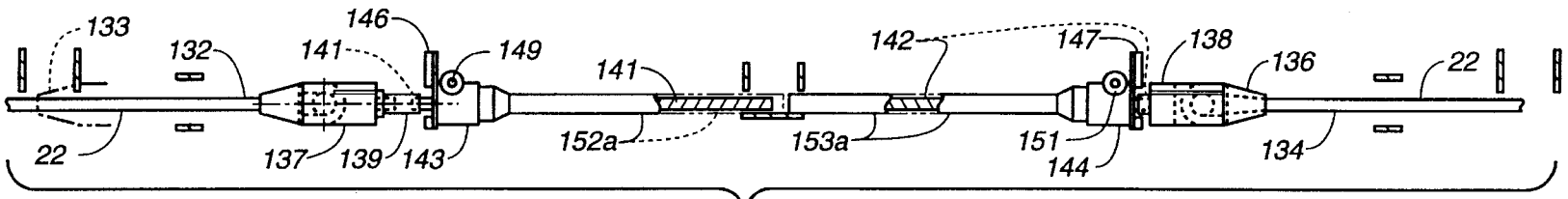
FIG. 4 is a side elevation view of the screw jack portion of the tensioning assembly of FIG. 3.

In the preferred manner of operation, therefore, when carrier unit 127 docks at an end terminal, the control device can poll or sample the sensed signal from load cell 139 as to haul rope tension. If the signal is outside the range stored in memory in control device 191, the control device will operate screw jack drive motor 162 in one direction or the other. Since the motor will be in contact with power brush 181, the motor will be actuated upon receipt of a control signal through conductors 192 to drive screw jack screw members 141 and 142 in one direction or the other. The sense signal from load cell 139 indicates that rope tension is below the desired tension range, the drive screws will be driven toward each other to tension the haul rope. If the load cell signal indicates that the haul rope tension is too high, the drive screws 141 and 142 will be driven in an opposite direction and extend out of housings 143 and 144 so as to relax or reduce tension in haul rope 22. As shown in FIGS. 3 and 4, the drive screws are in the maximum tension position. As will be seen in FIGS. 3 and 4, the left hand grip assembly 133 is shown in phantom in a moved position, representing maximum relaxation of the drive screws. In the normal setup, grip 133 and haul rope length 132 will be adjusted so as to position the grips approximately in the middle of the range when haul rope 22 is in about the middle of the desired tension range, so as to afford adjustment in either the direction of further tensioning or further relaxation.

Since only one or two tension adjustments will be required even in a system which has a substantial rope length and high temperature gradient, it is quite possible to effect rope tensioning only when the carrier unit is in the terminal and not be driven. This has the added advantage that dynamic tensioning forces due to friction and the like when the haul rope is being driven do not produce tension adjustments. Obviously, the desired or predetermined range of haul rope tension under static or no-load conditions is selected in part based upon the predicted dynamic loading during movement of the vehicle along the desired path.

Additionally, it should be appreciated that the same control system as above described in connection with a screw jack tensioning assembly can be used with the pneumatic assembly of the parent application, with a hydraulic tensioning assembly, or other mechanical tensioning assemblies. Thus, tension adjustments need only be made once or twice a day, with such adjustments being made, for example, only under no-load conditions or when there are no drive forces on the haul rope. This allows the carrier unit tension assembly to be actuated when the carrier unit is at a predetermined location along the path, usually a terminal. A pneumatic or hydraulic tension adjustment assembly also can produce adjustment only in response to the receipt of sensing signals from a load cell or pressure sensor which are outside a set range. This all occurs without any driving forces on the haul rope.

Since the screw jack tension adjusting assembly of FIGS. 3 through 6 does not include the docking capability of a floating pneumatic system, as set forth in the parent application, the tensioning assembly 51 of the present invention is preferably used with a separate docking assembly, generally designated 201. Docking assembly 201 can include a pair of drive wheels 202 driven through shafts 203 by drive motors 204. The drive wheels 202 can engage longitudinally extending plate members 206 which depend downwardly from the sides 156 and 157 of the rope coupling assembly 51.

A typical drive profile for the conveying system of the present invention is for bull wheel 21 to accelerate carrier unit 27 away from an end terminal at a rate of acceleration which is comfortable to passengers until the top speed of the conveying system is reached. This speed is maintained until a deceleration point, at which the drive wheel 21 is slowed to decelerate the load-carrying unit down to a crawl speed, again over a distance which is comfortable to the passengers. The carrier unit is driven at the crawl speed by bull wheel 21 until bumper 57 is close to docking surface 52, for example, within 18 inches of docking. At this point, bull wheel 21 can be disengaged from the drive and docking drive wheels 202 will be engaged with drive plates or shoes 206 carried by the undercarriage of the passenger carrier unit. As best may be seen in FIGURE 3, the front ends of the drive shoes or plates 206 can be inwardly tapered at 207 to gradually engage the drive wheels 202 as the carrier unit is advanced into the terminal.

With the drive bull wheel 21 disengaged, the docking drive wheels 202 then slowly advance the carrier unit until bumper 77 engages the docking surface 52, at which point drive by docking wheel is terminated. The actuation of motors 204 to drive the drive wheels can be accomplished by limit switches placed along the path of the carrier unit at the terminal and termination provided by a similar limit switch which would be engaged upon docking. The docking drive assembly 201 also acts as a further safety system in that it includes a gear reducer which limits driving to very low speeds and thereby insures that if the drive bull wheel should malfunction and continue to operate that the docking wheels 202 will act as a brake preventing overdriving by drive bull wheel 21.

From the above description of the apparatus comprising the conveying system of the present invention, it will be apparent that a method for maintaining the tension, in a traction member, such as a haul rope, in a conveying system is also provided. The present method is comprised of the steps of periodic sensing, for example, by load cell 139, the tension force in the traction member or haul rope 22. This sensing preferably is accomplished when there are substantially zero driving forces on haul rope 22, namely, when there is no torque and the passenger carrier unit is in the terminal. An additional step of the method of the present invention is the step of adjusting the tension force in the haul rope to within a predetermined range of forces by tension adjustment assembly in response to a sensed tension force outside the predetermined range. Thus, the present system provides a means for automatically adjusting tension in haul rope 22 by sensing rope tension each time the carrier unit comes into an end terminal and stops. At such a position, the haul rope tension adjustment assembly will be powered (although it could be continuously powered) and if the sensed tension force is outside the input range of tension forces, control device 191 will respond thereto by actuating the drive motor 162, or a pneumatic assembly, and adjust the tension force until the load cell indicates that the forces are now within the tension range. It will be that control device 191 can be programmed to make an adjustment form outside the range to virtually any position in the range, but might, for example, adjust to about a mid-position in the predetermined desired tension range.

This tension adjustment all occurs without operator intervention or operator monitoring. Moreover, in the preferred form, the steps of sensing and adjusting are accomplished by on-board sensing devices and adjustment assemblies.

Such an automatic haul rope tensioning method can be employed with a docking sequence which is similarly actuated by entry of the carrier unit into the terminal. The docking apparatus can be mounted at the terminal, rather than carried by the carrier unit, although it would be possible to employ a reversal of parts in which drive wheels are carried by the carrier unit and actuated only in the terminal to drive against a terminal mounted drive shoe and thereby urge the carrier unit into engagement with a docking surface.

What is claimed is:

1. A conveying system comprising:

a traction member mounted for movement along a path;

a drive assembly mounted in driving engagement with said traction member to advance said traction member along said path;

a carrier unit coupled to said traction member by a coupling assembly formed for adjustment of the tension forces in said traction member;

a tension sensing device carried by said carrier unit and formed to sense tension forces in said traction member and to produce sensing signals proportional thereto; and said coupling assembly including a tension adjustment assembly coupled to said traction element and connected to said tension sensing device to receive said sensing signals, said tension adjustment assembly being automatically responsive to said sensing signals from said tension sensing device to adjust tension forces in said traction members according to predetermined criteria.

2. The conveying system as defined in claim 1 wherein, said tension adjustment assembly is responsive to said signals from said tension sensing device only when driving forces on said traction member are substantially zero.

3. The conveying system as defined in claim 1 wherein, said tension adjustment assembly includes a control device connected to receive said signals from said tension sensing device, said control device further having memory for storage of user input and a user input device, and said tension adjustment device being responsive to signals from said tension sensing device outside a range of values stored in said memory to be actuated to effect one of tensioning and relaxing of said traction member.

4. The conveying system as defined in claim 1 wherein, said traction member is a haul rope.

5. The conveying system as defined in claim 1 wherein, said traction member is an endless loop-type haul rope.

6. The conveying system as defined in claim 1 wherein, said tension adjustment assembly includes a screw jack assembly, and a motor coupled to drive said screw jack assembly and coupled to be actuated by said tension sensing device.

7. The conveying system as defined in claim 6 wherein, said tension sensing device is a load cell;

a control device electrically connected between said load cell and said motor; and said motor is an electric motor.

8. The conveying system as defined in claim 7 wherein, said motor is formed with an electrical motor-carried contact; and said path includes a terminal therealong having a source of electricity and an electrical terminal-mounted contact positioned to engage said electrical motor-carried contact for powering of said motor only when said carrier unit is at said terminal.

9. The conveying system as defined in claim 6 wherein, said traction member is a loop-type haul rope;

said screw jack assembly includes a first screw jack member and a second screw jack member;

said haul rope is coupled at one end to said first screw jack member and is coupled at another end to said second screw jack member; and said motor being coupled to drive said first screw jack member and said second screw jack member in opposite directions extending along said haul rope.

10. A conveying system comprising:

a haul rope mounted for movement along a path;

a drive assembly mounted in driving engagement with said haul rope to advance said haul rope along said path;

a carrier unit coupled to said haul rope by a coupling assembly formed for adjustment of the tension forces in said haul rope;

a tension sensing device mounted to sense tension forces in said haul rope and to produce sensing signals proportional thereto;

said coupling assembly including a tension adjustment assembly coupled to said haul rope and formed for connection to said tension sensing device when said carrier unit is at a predetermined location along said path, said tension adjustment assembly being formed for actuation in response to receipt of sensing signals only when driving forces on said haul rope are substantially zero.

11. The conveying system as defined in claim 10 wherein, said tension sensing device is coupled to said haul rope; and said tension adjustment assembly is carried by said carrier unit.

12. The conveying system as defined in claim 11 wherein, said tension adjustment assembly is a screw jack assembly coupled to said haul rope.

13. The conveying system as defined in claim 11 wherein, said tension adjustment assembly includes a control device carried by said passenger carrier unit and coupled to receive said sensed signals and responsive thereto to actuate said screw jack assembly to effect one of elongation and shortening of said screw jack assembly to cause one of relaxation and tensioning of said haul rope based upon criteria stored in said control device.

14. The conveying system as defined in claim 10, and docking drive means mounted proximate said path and formed to engage a surface of said carrier unit to drive said carrier unit to a precise docked position relative to a terminal location along said path.

15. A method for maintaining the tension in a traction member in a conveying system having a carrier unit coupled for driving along a path by said traction member, comprising the steps of:

periodically sensing the tension force in said traction member while said traction member is under substantial zero driving force using a sensing device carried by said carrier unit; and adjusting the tension force in said traction member to within a predetermined range of forces by a tension adjustment assembly carried by said carrier unit in response to a sensed tension force outside said predetermined range.

16. The method as defined in claim 15 wherein, said sensing step is accomplished by sensing the tension force in a haul rope type traction member using a sensing device directly coupled to said haul rope; and said adjusting step is accomplished by driving said adjustment assembly by a motor carried by said carrier unit.

17. The method as defined in claim 16 wherein, said adjusting step is accomplished by employing a screw jack tension adjustment assembly coupled to said haul rope and carried by said carrier unit.

18. A method for maintaining the tension in a haul rope in a conveying system having a carrier unit coupled for driving along a path by said haul rope, comprising the steps of:

periodically sensing the tension force in said haul rope by a tension sensing device coupled to said haul rope at said carrier unit; and automatically adjusting the tension force in said haul rope to within a predetermined range of forces by a powered tension adjustment assembly carried by said carrier unit and connected to receive signals from said tension sensing device as to the sensed tension force.

* * * * *